US007628165B2

(12) United States Patent
Rothweil

(10) Patent No.: US 7,628,165 B2
(45) Date of Patent: Dec. 8, 2009

(54) PORTABLE ENCLOSURE

(75) Inventor: Daniel Anthony Rothweil, Poway, CA (US)

(73) Assignee: D-Squared Product Development, Poway, CA (US)

( * ) Notice: Subject to any disclaimer, the term of this patent is extended or adjusted under 35 U.S.C. 154(b) by 284 days.

(21) Appl. No.: 11/827,751

(22) Filed: Jul. 13, 2007

(65) Prior Publication Data

US 2008/0047597 A1 Feb. 28, 2008

Related U.S. Application Data

(60) Provisional application No. 60/839,614, filed on Aug. 23, 2006.

(51) Int. Cl.
*E04H 15/48* (2006.01)

(52) U.S. Cl. ..... 135/135; 135/147; 135/156; 403/170; 52/646

(58) Field of Classification Search ..... 135/124, 135/128, 131, 135, 137, 147, 159, 144, 156; 403/169, 170, 174, 178; 5/97; 52/79.5, 86, 52/645–646

See application file for complete search history.

(56) References Cited

U.S. PATENT DOCUMENTS 1,846,496 A * 2/1932 Mills ..... 135/98
2,864,389 A * 12/1958 Smith et al. ..... 135/98
3,929,146 A * 12/1975 Maiken ..... 135/98
4,202,363 A * 5/1980 Watts et al. ..... 135/98
4,750,509 A * 6/1988 Kim ..... 135/135
4,941,499 A * 7/1990 Pelsue et al. ..... 135/125
4,966,178 A * 10/1990 Eichhorn ..... 135/123
5,666,986 A * 9/1997 Fox ..... 135/135
5,884,646 A * 3/1999 Ju ..... 135/135
6,581,617 B2 * 6/2003 Ham et al. ..... 135/135
6,776,179 B1 * 8/2004 Chen ..... 135/147
6,854,476 B1 * 2/2005 Chai ..... 135/135

* cited by examiner

*Primary Examiner*—Winnie Yip
(74) *Attorney, Agent, or Firm*—David B. Waller; The Nath Law Group

(57) ABSTRACT

The present invention is a collapsible enclosure comprising, a plurality of structural support beams, a hub having a plurality of attachment means and a pressure plate positioned below the attachment means to which one end of the structural support beams are attached and a cover disposed upon and traversing between the structural support beams. The top portion of the cover having means for receiving the plurality of structural support beams and the bottom portion having adapters for receiving the other ends of the plurality of structural support beams. The cover may have one or more openings and one or more flaps to secure the one or more openings.

18 Claims, 8 Drawing Sheets

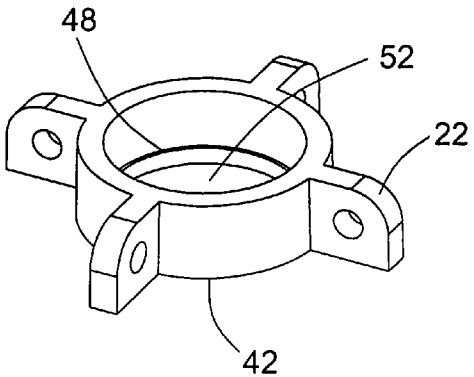
Fig 5A
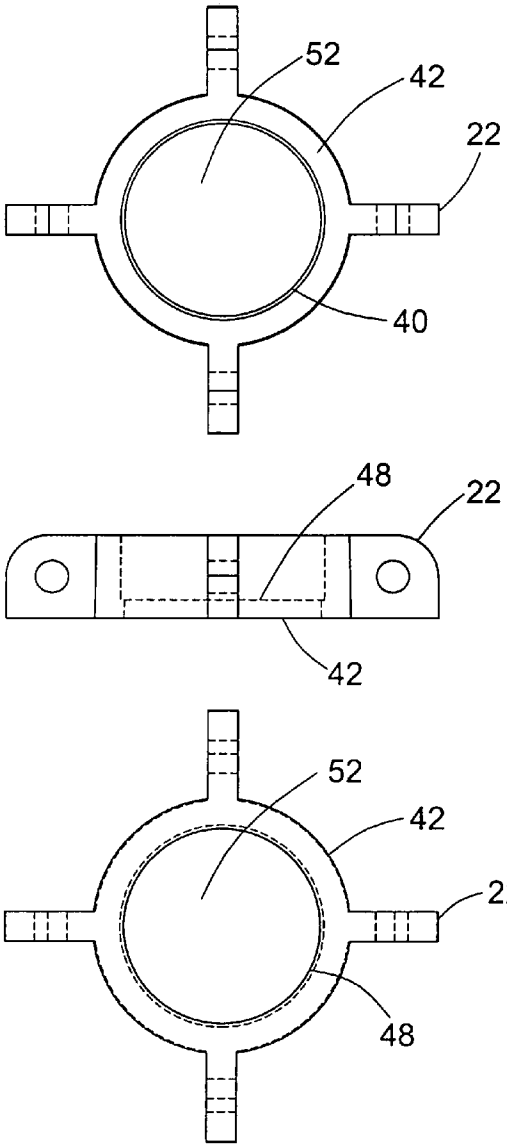

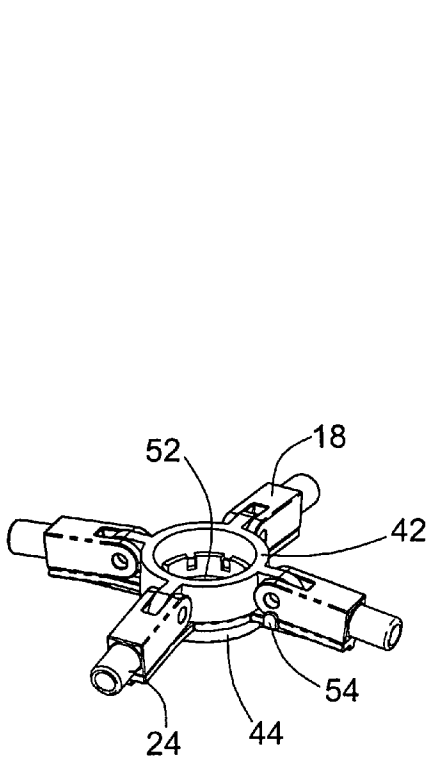
Fig 5C
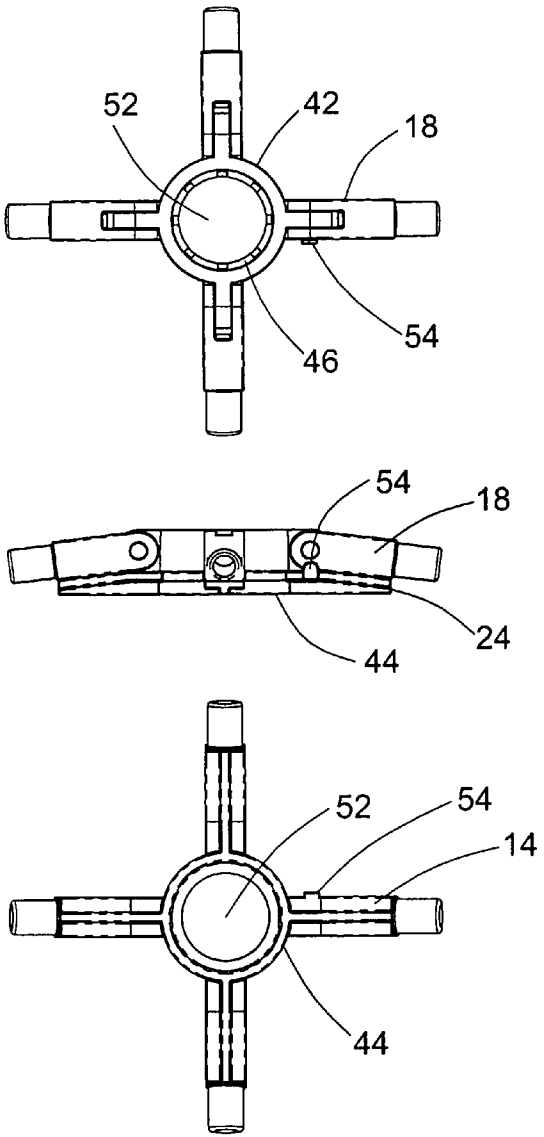

PORTABLE ENCLOSURE

CROSS-REFERENCE TO RELATED APPLICATIONS

This is a regular application of provisional patent application Ser. No. 60/839,614 filed 23 Aug. 2006.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

1. Field of Invention

This invention relates to portable devices used for housing individuals, objects or food. More particularly, to sheltering individuals from the environment, protecting objects from weather conditions or preventing insects and other contaminants from accessing or entering food prior to being consumed.

2. Description of Related Art

A number of devices are available commercially for these purposes. Devices for sheltering individuals from the environment include such enclosures as tents. While there are a wide variety of different types of tents that have been patented, the tents disclosed in U.S. Pat. Nos. 3,794,054, 3,874,397, 4,202,363 and 7,185,666 are most relevant. In each of these tent structures the force generated by the second or lower hub in the upward direction from the support struts connected to the second hub and pole members requires locking interaction with the first hub connected to the pole members. This force and the complimentary interface between both hubs locks the tent into position. An additional locking mechanism may be provided such as that described in U.S. Pat. No. 3,874,397. Guiding rods may be utilized to assure that the hubs properly interface such as those described in U.S. Pat. Nos. 3,794,9054 and 4,202,363 and geometric interfaces on the two hubs may be provided to assure proper interface orientation such as that described in U.S. Pat. No. 7,185,666. Similar structures may also be constructed for protecting objects such as cars, blinds for hunting, or equipment from weather conditions that might damage these items. In one particularly relevant patent, U.S. Pat. No. 5,628,338 a five-hub framework is required to maintain each of the four walls and ceiling of a collapsible blind structure. One end of four leg members is rotatably attached to each hub with the other ends inserted into pockets formed in the corners of the cover. The hubs permit 90° rotation of all of the leg members in a one directional plane for collapsing the structure. In the open position the leg members exert force against the hub at 90° rotation bowing the leg members and locking the enclosure in the open configuration.

Smaller enclosures of the same construction may be utilized to protect food that has been placed on a table either inside or out during events such as parties, special events, picnics, fairs, carnivals, etc. A number of such devices are available commercially. The most common is called a food tent (available though www.improvementscatalog.com and www.cooking.com) and is a netted dome having a handle positioned at the top and about the center of the dome to allow the user to easily lift the dome to access the food protected within. Unfortunately, because these devices do not have a base, insects can easily access the food by crawling under the edge of the dome or through the openings between the wooden slats of the picnic table. In addition in the event that there is a breeze the dome can be easily lifted and blown off the table.

Although portable tents and smaller collapsible structures have been disclosed in a number of different constructions, no one prior design is believed to be optimal and there remains a need in the art for enclosures that are optimized for their particular use, may be more easily erected or collapsed, provide similar structural integrity with fewer parts to be assembled, less expensive and/or more portable than those in the prior art.

BRIEF SUMMARY OF THE INVENTION

The present invention is a collapsible enclosure comprising: a plurality of structural support beams; a hub having a plurality of attachment means to which one end of the plurality of structural support beams are attached and a pressure plate positioned below said attachment means; a cover disposed upon and traversing between the structural support beams having a top portion and a bottom portion, the top portion having means for receiving the plurality of structural support beams, the bottom portion having adapters for receiving the ends of the plurality of structural support beams; one or more openings and one or more flaps to secure the one or more openings.

In another aspect of the present invention a collapsible enclosure is provided comprising: a plurality of structural support beams; a first hub having a plurality of attachment means to which one end of the structural support beams are attached; a second hub having a plurality of attachment means and pressure plate positioned below said attachment means; a plurality of strut members having inner and outer ends the outer ends being pivotally attached to a structural support beam and the inner ends being pivotally attached to the attachment means of the second hub such that when engaging the pressure plates the strut members are forced outward from the second hub and against the structural support beams; a cover disposed upon and traversing between the structural support beams having a top portion and a bottom portion, the top portion having means for receiving the plurality of structural support beams, the bottom portion having adapters for receiving the ends of the plurality of structural support beams; one or more openings and one or more flaps to secure the one or more openings.

In one embodiment of this aspect of the present invention the pressure plates of the hub or second hub may be angled downward from the plane of the hub. This angle may be not less than 5 degrees and not more than 85 degrees, preferably not less than 10 degrees and not more than 60 degrees.

In yet another aspect of the present invention a collapsible enclosure is provided comprising: a plurality of structural support beams; a hub having an attachment means to which one end of the plurality of structural support beams are attached and a rotating member having a plurality of pressure plates for engaging the pressure plates and plurality of structural support beams forcing the plurality of structural support beams outward from the hub; a cover disposed upon and traversing between the plurality of structural support beams having a top portion and a bottom portion, the top portion having means for receiving the plurality of structural support beams, the bottom portion having adapters for receiving the other ends of the plurality of structural support beams; one or more openings and one or more flaps to secure the one or more openings.

In another aspect of the present invention a collapsible enclosure is provided comprising: a plurality of structural support beams; a first hub to which one end of the plurality of structural support beams are attached, a second hub positioned beneath the first hub having an attachment means and a rotating member having a plurality of pressure plates; a plurality of strut members having inner and outer ends the outer ends being pivotally attached to a structural support beam and the inner ends being pivotally attached to the attachment member of the second hub, the rotating member able to be rotated for engaging the pressure plates and struts forcing the struts outward from the hub and against the plurality of structural support beams; a cover disposed upon and traversing between the structural support beams having a top portion and a bottom portion, the top portion having means for receiving the plurality of structural support beams, the bottom portion having adapters for receiving the ends of the plurality of structural support beams; one or more openings and one or more flaps to secure the one or more openings.

In one embodiment of this aspect of the present invention the rotating member of the hub further comprises a handle positioned below the pressure plates for gripping and rotating the rotating member into position engaging and forcing the plurality of structural supports beams outward from the hub.

In still another embodiment the hub further comprises a rotation stop on the pressure plates to prevent over rotation of the rotating member.

In yet another embodiment of the present invention the pressure plates of the rotating member of the second hub may be angled downward from the plane of the second hub. This angle may be not less than 5 degrees and not more than 85 degrees, preferably not less than 10 degrees and not more than 60 degrees.

In yet another aspect of the present invention a collapsible enclosure is provided comprising: a plurality of structural support beams; a first hub to which one end of the structural support beams are attached, a second hub positioned beneath the first hub that does not interface with the first hub in the open or collapsed configuration the second hub having a plurality of attachment means and a pressure plate positioned below the attachment means; a plurality of strut members having inner and outer ends, the outer ends being pivotally attached to a structural support beam and the inner ends being pivotally attached to the attachment means of the second hub; a cover disposed upon and traversing between the structural support beams having a top portion and a bottom portion, the top portion having means for receiving the plurality of structural support beams, the bottom portion having adapters for receiving the ends of the plurality of structural support beams; one or more openings and one or more flaps to secure the one or more openings.

In one embodiment of this aspect of the present invention the pressure plates of the second hub may be angled downward from the plane of the second hub. This angle may be not less than 5 degrees and not more than 60 degrees, preferably not less than 10 degrees and not more than 45 degrees.

In one embodiment of all aspects of the present invention the collapsible enclosure may further comprise hinged joints on the plurality of structural supports beams between their ends so that they may be folded when the enclosure is in the collapsed configuration.

In yet another embodiment of the present invention the inner ends of the strut members exert a downward bias against the pressure plates of the hub maintaining the structure in it's constructed configuration. Correspondingly, downward pressure on the first hub causes the inner ends of the strut members to move below it's outer ends thereby overcoming the downward bias on the second hub and allowing the enclosure to collapse.

In still another embodiment of the present invention the adapters for receiving the other ends of the plurality of structural support beams are flexible pockets.

In yet another embodiment the hub comprising the pressure plates further comprises a locking structure for mechanically locking the strut members in position maintaining the downward bias toward the pressure plates by the strut members.

When the enclosure of the present invention is provided in a smaller configuration for protecting food the device may further comprise straps for securing the enclosure to a surface.

DETAILED DESCRIPTION OF THE INVENTION

Figure 2:
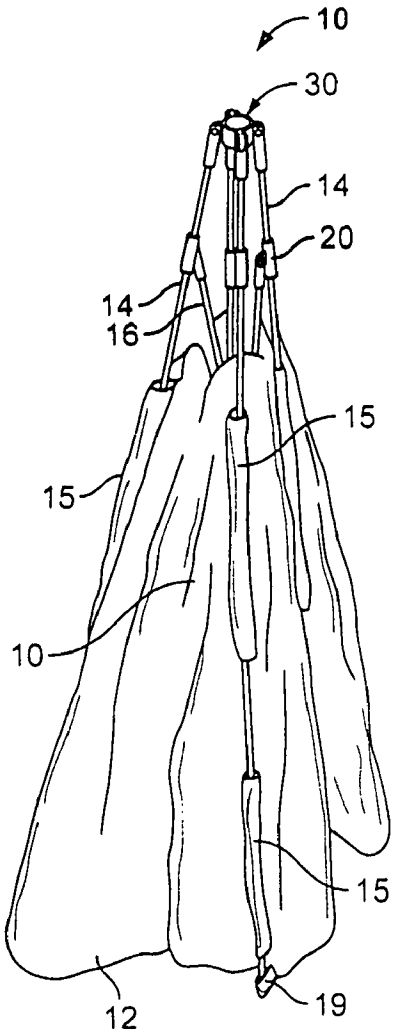
FIG. 2 A perspective view of the collapsed structure of the preferred embodiment of the present invention.

Unless defined otherwise, all terms used herein have the same meaning as are commonly understood by one of skill in the art to which this invention belongs. All patents, patent applications and publications referred to throughout the disclosure herein are incorporated by reference in their entirety. In the event that there is a plurality of definitions for a term herein, those in this section prevail.

The term "affixing means" as used herein refers to a means for securely, yet reversibly attaching structural support beams to the cover by a variety of methods including for example providing an insert sleeve, hooks, ties, pockets and the like.

The present invention is a collapsible enclosure that may be provided in a one or two hub configuration. In either of these configurations one of the hubs will be static having pressure plates below the attachment means or dynamic having an attachment means and a rotating member containing the pressure plates.

In the simplest configuration the enclosure comprises; a plurality of structural support beams, a hub having a plurality of attachment means and a pressure plate positioned below the attachment means to which one end of the structural support beams are attached; a cover disposed upon and traversing between the structural support beams having a top portion and a bottom portion, the top portion having means for receiving the plurality of structural support beams, the bottom portion having adapters for receiving the ends of the plurality of structural support beams; one or more openings and one or more flaps to secure the one or more openings. The hub in this configuration is static but may be substituted with a dynamic hub. In the static configuration the structural support beams are pivoted about the attachment means and brought to bear on the pressure plates at the base of each attachment means. When in the open position the other ends of the structural support beams are fitted into the adapters at the base of the cover maintaining the downward bias against the pressure plates. When using the dynamic hub the structural support beams are rotated about the attachment means toward the rotating member and their other ends fitted into the adapter at the base of the cover. The structural support beams are spread to the maximum distance permitted by the cover. Pressure is applied downward on the hub and the rotating member is rotated engaging the structural support beams. The downward bias thus created against the pressure plates by the structural support beams maintains the enclosure in the open position.

Alternatively, the enclosure may be provided in a two hub configuration. The first hub provides an attachment means for one end of the structural supports. The second hub may be static or dynamic as described above and is connected to the structural supports via strut members. When using the static hub pressure plates are provided below the attachment means on the second hub where the inner ends of the struts are attached. The outer ends of the struts are attached to the structural support beams and when opening the enclosure the inner ends of the struts are brought to bear upon the pressure plates. This action locks the struts in place maintaining the pressure applied to the structural support beams thereby securing the enclosure in the open position. When using a dynamic hub the enclosure is locked in the open position by the rotation of the pressure plates to engage the inner ends of the struts and maintain their pressure against the structural support beams.

Although the invention will be described in detail with respect to particularly preferred embodiments thereof, it will be understood by those of ordinary skill in the art that variations and modifications may be effected without departing from the subject matter coming within the scope of the claims, which subject matter is regarded as the invention.

Structural Support Beams

The structural support beams 14 of the present device are elongated shafts that are sufficiently flexible to allow them to bend into the form of the cover 12 and maintain the cover 12 in and open and upright position. In view of this, the structural support beams 14 may be made of a variety of materials and in a variety of configurations that provide such flexibility. For example, the structural support beams 14 may be made of fiberglass, carbon fiber, plastic or wood. Possible configurations include round cylindrical, hollow round cylindrical or elongated beam having a vertical cross section in the shape of an "X" or cross. The length of the structural support beams 14 will depend on the size of the enclosure 10 and the collapsed configuration desired.

Figure 1:
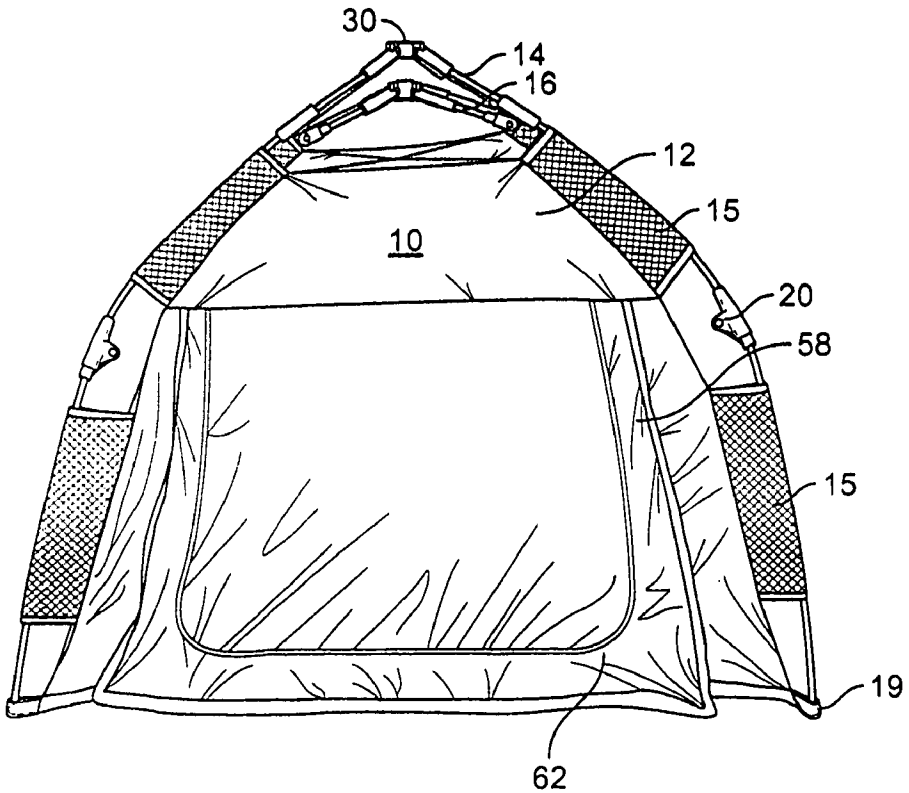
FIG. 1 A perspective view of one preferred embodiment of the present invention.

The plurality of structural support beams 14 are pivotally attached at one end to a hub. The cover 12 is attached to the structural support beams 14 by affixing means 15. In a preferred embodiment the affixing means 15 are a plurality of sleeves along the corners of the top portion of the cover 12. Preferably there are two lengths of sleeves one along the ascending portion of the top portion and the other along the descending portion of the top portion (FIG. 1). Correspondingly, the ends of the structural support beams 14 may fit into adapters 19 provided at the corners of the cover 12. Preferably the adapters 19 are pockets able to receive the ends of the structural support beams 14. Alternatively, hooks may be connected at about regular intervals along the top portion of the cover 12 in line with the placement of the structural support beams 14 clasping around the beams securing the cover 12 in an open and upright position.

In another configuration the structural support beams 14 are positioned in place within the enclosure 10. The structural support beams 14 are inserted into the enclosure 10 through the opening and the ends inserted into adapters 19 or pockets positioned in the corners of the interior of the cover 12. The apex of the top of the cover 12 may have a means for affixing to the hub such as a tie. Alternatively, hub may have a small magnetically susceptible metal disc or snap affixed at the apex. In this case the apex of the cover 12 could have a magnet or snap respectively to connect to the hub.

Figure 3:
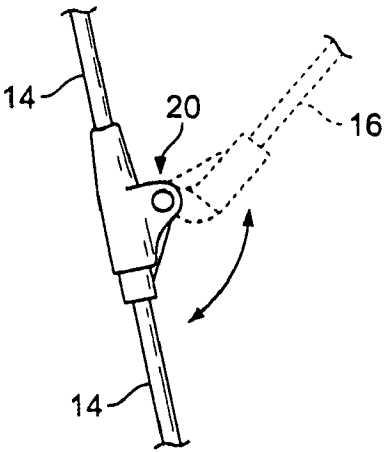
FIG. 3 A side view of the hinged joints on the structural supports beams.

Depending on the actual size of the enclosure 10 the structural support beams 14 may be provided in a single continuous length or they may be provided in a series of connected sections of a particular length. Each section is preferably pivotally connected 20 to the other allowing a rotation of from 0 to 180 degrees (FIG. 3). Alternatively, an elastic cord running through their lengths to prevent one or more of the lengths from being lost may connect these sections. The length of these sections may be determined by the desired size of the enclosure 10 in its collapsed form.

Static Pressure Plate Hub

Figure 4:
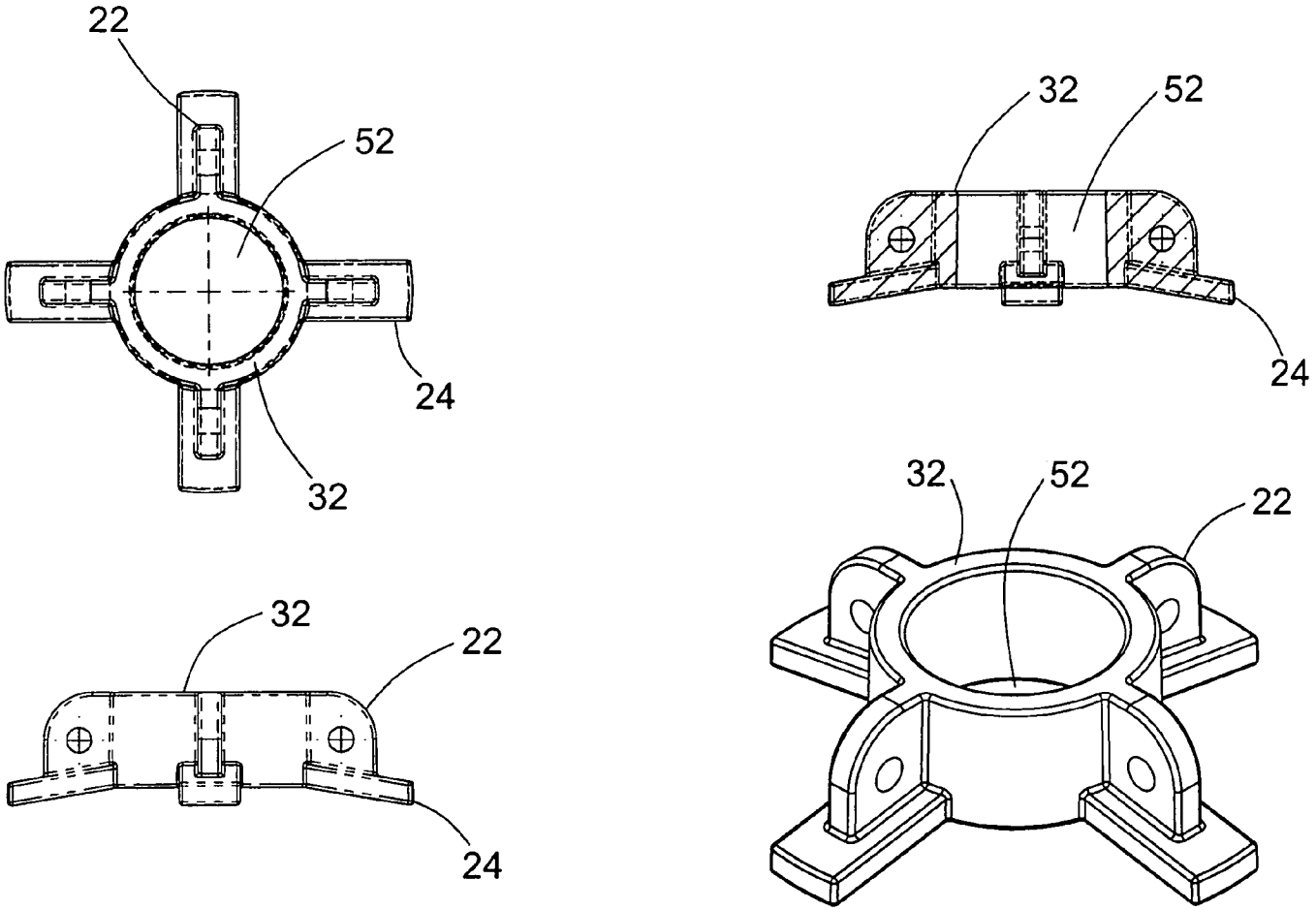
FIG. 4 A top view, side view, cross-sectional view and perspective view of a static pressure plate hub.

The static pressure plate hub 32 (FIG. 4) comprises a plurality of connectors 22 radiating outward from the center of the hub 32 and oriented perpendicular to the plane of the hub 32 for pivotally affixing a plurality of structural support beams 14. A pressure plate 24 is provided below each connector 22 to engage the structural support beams 14 when they are pivoted to and beyond a desired angle. This angle is calculated to provide sufficient resistance from the pressure plate 24 against the structural support beam 14 when the other ends are affixed within the adapters 19 of the bottom portion of the cover 12 to maintain the enclosure 10 in the opened position. This angle is not less than 10 degrees and not more than 85 degrees. Preferably this angel is about 14 degrees to about 60 degrees for an enclosure 10 that may be used as a tent for housing three or less persons. The hub 32 may be provided in a variety of shapes with the circular configuration preferred. The structural support beams 14 may be affixed to the connectors 22 of the hub 32 by a variety of methods that allows the beams to pivot in a plane about the connector. Preferably the ends of the structural support beams 14 are provided with adapters 18 preferably in a U-shape for receiving the connector 22. The U-shaped adapter 18 and connector 22 have central apertures that align when fitted together for receiving a pin. A cotter pin or rivet is a preferred method of retaining the end of the structural support beams 14 pivotally mounted to the connector 22 of the hub 32. The hub 32 and adapters 18 for the ends of the structural support beams 14 may be made of a variety of materials that provide sufficient strength and integrity to prevent breakage when the structural support beams 14 are brought to bear on the pressure plates 24 to form the enclosure 10.

Dynamic Pressure Plate Hub

Figure 5B:
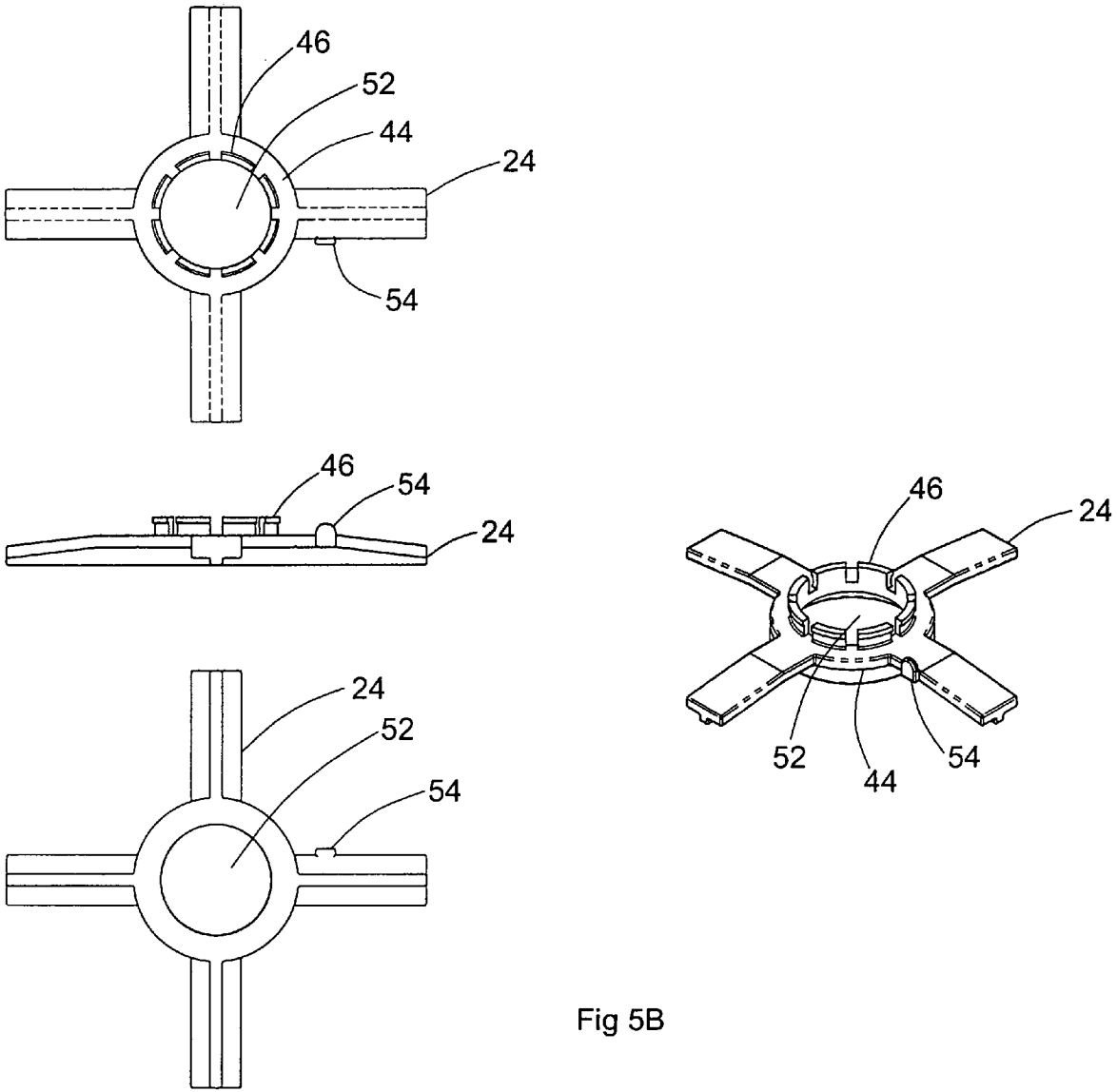
FIG. 5 (A) top view, side view, bottom view and perspective view of a stationary member of the dynamic pressure plate hub, (B) top view, side view, bottom view and perspective view of the rotating member of the dynamic pressure plate hub, (C) top view, side view, bottom view and perspective view of the assembled dynamic pressure plate hub and connecting adapters for the structural support beams.

The present invention also provides a hub having a rotating member 44 wherein the stationary member 42 comprises a central cavity 52 with a radial groove 48 for receiving the rotating member 44 and a plurality of connectors 22 radiating outward from the center of the hub and oriented perpendicular to the plane of the hub for pivotally affixing a plurality of structural support beams 14 (FIG. 5). The rotation member 44 comprises a shaft having a upper end and a lower end. The upper end having a protruding lip 46 for insertion into the radial groove 48 of the central cavity 52 of the stationary member 42. The lower end having a plurality of pressure plates 24 arranged in such manner so as to be positioned below each connector 22 of the stationary member 42 when rotated. The upper end of the rotating member 44 is inserted into the cavity of the stationary member 42 until the protruding lip 46 of the rotating member 44 snaps into the radial groove 48 of the stationary member 42. The joining of the groove and lip prevent the members from separating and allows the rotating member 44 to rotate about an axis running parallel through the center of the shaft of the rotating member 44. The pressure plates 24 may further comprise ramps on one or both sides to assist in rotating the rotating member 44 into position below the structural support beams 14. In one preferred configuration the pressure plates 24 have a ramp on one side and a stop ridge 54 on the other. The ramp assists in rotating the rotating member 44 into position and the stop ridge 54 prevents further rotation after the pressure plates 24 are positioned under the structural support beams 14.

Figure 6:
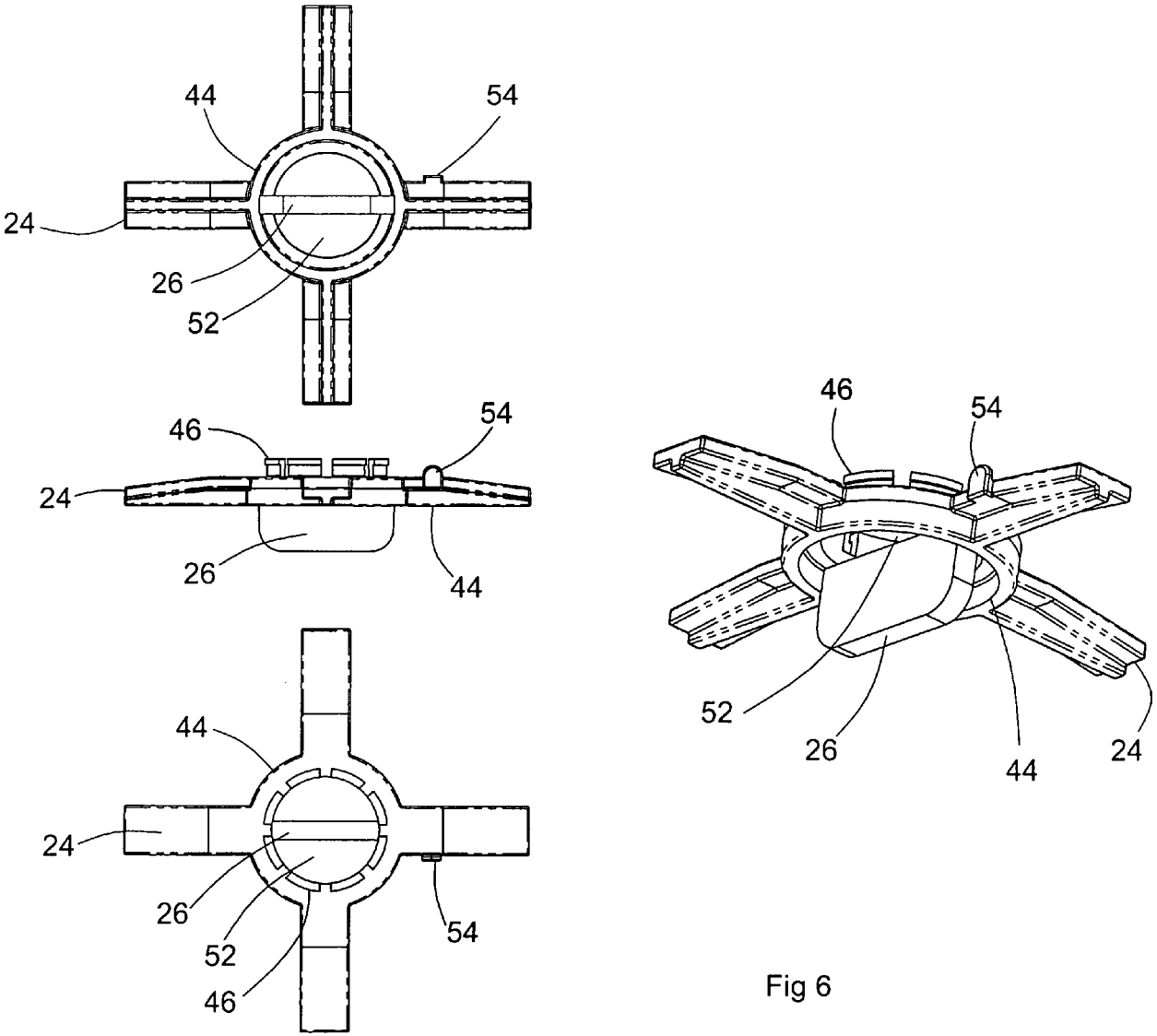
FIG. 6 A top view, side view, bottom view and perspective view of the rotating member of the dynamic pressure plate hub with handle.

In another preferred embodiment the rotating member 44 further comprises a gripping means 26 for assisting in the rotation of the rotating member 44 (FIG. 6). The gripping means 26 permits the user to reduce the resistance necessary to rotate the pressure plates 24 under the connectors 22 of the stationary member 42. In one configuration a gripping means 26 is a handle that is positioned perpendicular to the central axis of the shaft with ends affixed at the lower end of the rotating member 44 or to the base of two or more pressure plates 24 spaced sufficiently apart and at a distance form the pressure plates 24 to permit gripping by a hand. In use the handle is gripped and pulled downward bowing the structural support beams 14 slightly outward reducing the resistance necessary to rotate the pressure plates 24 under the structural support beams. The handle is then rotated until the structural support beams 14 come into contact with the stop ridges 54. In an alternative configuration the gripping means 26 is a tap positioned below and affixed to the base of the pressure plate 24 (FIG. 6).

Figure 7:
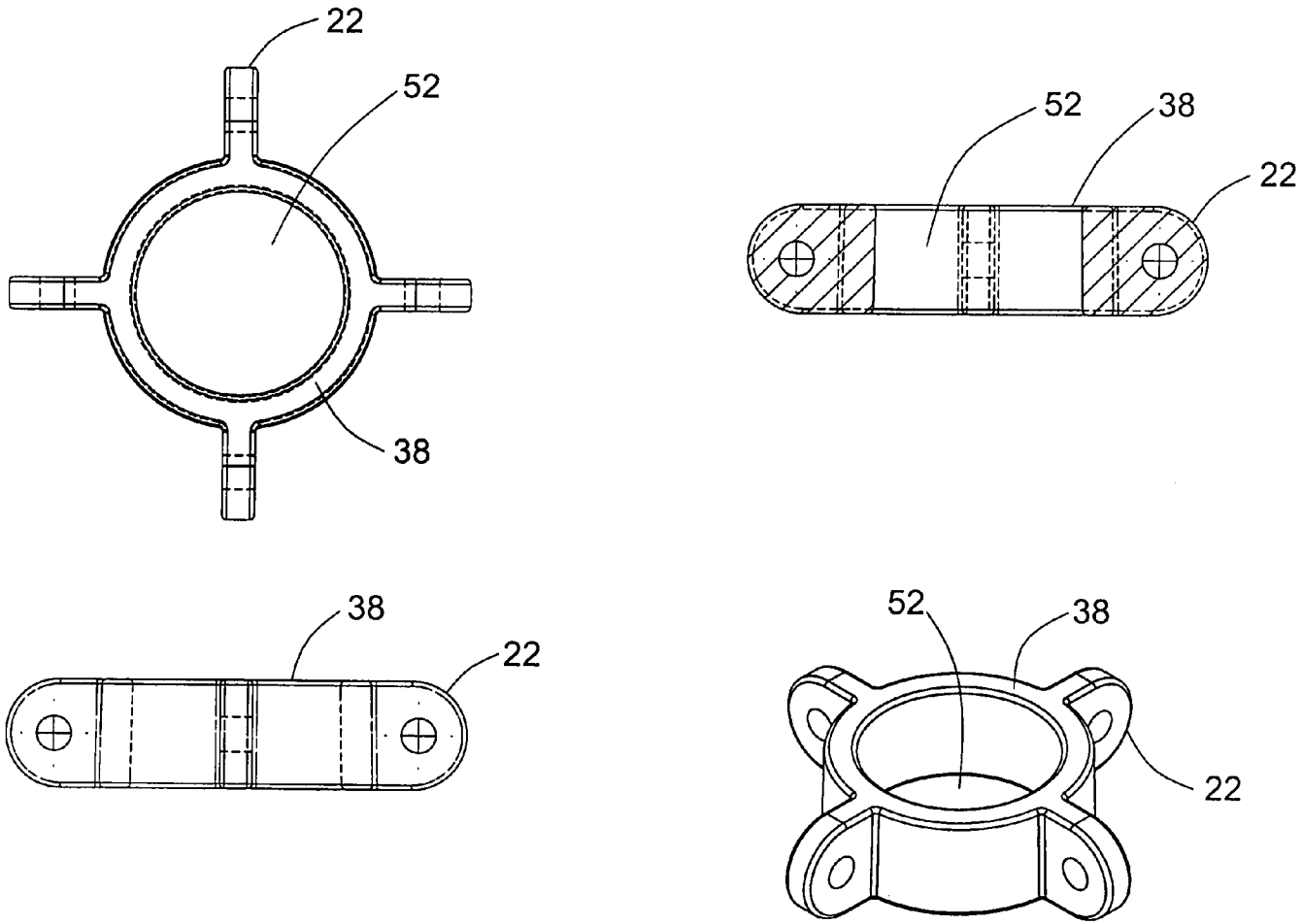
FIG. 7 A top view, side view, cross-sectional view and perspective view of the first hub.

In a two-hub configuration the first hub 38 comprises a plurality of connectors 22 radiating outward from the center of the hub 38 and oriented perpendicular to the plane of the hub 38 for pivotally affixing one end of a plurality of structural support beams 14 (FIG. 7). The second hub, positioned below the first hub 38, is the static pressure plate hub 32 described above wherein the connectors 22 radiating outward from the center of the hub 32 and oriented perpendicular to the plane of the hub 32 are for pivotally affixing one end of a plurality of strut members 16. The other ends of the strut members 16 are pivotally affixed to the structural support beams 14. In the partially collapsed configuration the inner ends IE of the struts 16 are below the outer ends OE and there is no contact with the pressure plate 24. In the fully open configuration the inner ends IE of the struts 16 rise above the outer ends OE and engage the pressure plate 24. The pressure plate 24 exerts an upward bias against the inner ends IE of the struts 16 locking the enclosure 10 in the fully opened position. To release the upward bias of the pressure plate 24 the second hub 32 is pulled downward until the inner ends IE of the struts 16 are below the outer ends OE.

In a similar two-hub configuration the second hub is the dynamic pressure plate hub 34 described above. In the partially collapsed configuration the rotating member 44 is rotated until the pressure plates 24 are positioned below and not in contact with the inner ends IE of the struts 16 which are below the outer ends OE. In the fully open configuration upward pressure is applied to the second hub 34 moving the inner ends IE of the struts 16 above the outer ends OE and engaging the pressure plate 24. The pressure plate 24 exerts an upward bias against the inner ends IE of the struts 16 locking the enclosure 10 in the fully opened position. To release this upward bias the rotating member 44 is turned until the inner ends IE of the struts 16 no longer engage the pressure plate 24. Preferably the rotating member 44 comprises a handle affixed to it's lower end at the base of the pressure plate 24 to allow the user to more easily turn the rotating member 44.

Cover

The cover 12 of the present invention is made of a material that is resilient to wear and stretching, resistant to UV degradation and tearing and light weight for ease of transport. If the structure is being made to protect food the cover 12 is preferably made of a material having a weave or mesh that allows the user to see and/or identify the food stored in the enclosure 10 and prevents insects and most debris from entering the enclosure 10. A number of materials that have these characteristics are commercially available and are often used for preparing tents and other large enclosures.

The cover 12 may have one or more openings 58 that allow the user enter and exit the enclosure 10. The size of the openings 58 will depend on the items to be housed within the enclosure 10 and the types of access desired. In a food enclosure 10 configuration, the size of the openings 58 is balanced with the desire to secure the contents from access by unwanted insects and debris. In particular the diameter of the plates and dishes the user intends to place in the enclosure 10 will determine the width of the opening. For example, if the diameter of a plate to be stored in the enclosure 10 is 9" then the width of the opening should be larger than 9". Correspondingly if the height of a bowl to be placed in the enclosure 10 is 7" then the height of the opening should be at least 7". Correspondingly in a shelter or tent configuration the height of the opening will depend on the average size of the individual that may utilize the enclosure 10 and whether it is desired that access be available in a fully upright, bent-over or kneeling posture. The width will depend on whether access is desired by a single individual alone or an individual carrying items to be placed in the enclosure 10. If the enclosure 10 is to be used for equipment such as vehicles or machinery the height and width of the desired opening will depend on the dimensions of the equipment. Since this access may be larger than desired for regular ingress and egress a smaller opening may be provided within the closure flap for the equipment opening.

For multiple access there may be more than one opening and the openings 58 may be positioned on more than one side. In a food enclosure 10 configuration increasing the number of openings 58 and the amount of time for which the doors are opened during access will increase the opportunity for unwanted entry by insects and debris. Consequently, it is preferable to limit the number of openings 58 in the cover 12. Correspondingly in a shelter or tent configuration multiple opens may include windows as well as doors 62. It is preferred that a shelter for individuals contains one door for ingress and egress and at least one window for circulation. If the enclosure 10 is for a vehicle it may be beneficial to have two doors 62, an entry on one side and an exit on the opposite side.

The cover 12 may further comprise a means for securing the door positioned above and about the center of the opening to prevent interference with ingress and egress as desired. A variety of securing means may be utilized with the present invention including a latch, Velcro™, magnet, or tie. The type and position of the securing device will depend on the length and height of the door 62. For example, in a smaller enclosure 10 if the door 62 is 9" in length it may not be feasible to place the securing means 7" or more above the door 62. Consequently, the hook portion of the Velcro™ could be affixed at about 1-2" above the center of the opening and the felt portion of the Velcro™ could be placed facing inward on the inside surface of the door about 2-3" inches from the top and about the center of the door. In this configuration the user could roll the door upward and easily secure the door 62 open with one hand. In a larger structure it may be beneficial to secure the door to one side of the opening. In this configuration a restraining strap with securing snap or Velcro™ may be provided on the inside of the enclosure 10 to wrap about the gathered door securing it to one side of the opening.

In a food enclosure 10 securing straps may be provided and affixed to the base of the cover 12 so that it may be secured to the surface on which it is placed. The straps may be made of a wide variety of materials that provide sufficient strength and durability to maintain the enclosure 10 on the intended surface. Nylon strapping similar to that used in camping equipment would be preferable. These straps may be secured by tying, by snap connectors similar to those used on backpacks or by loop through strap connectors similar to those used on luggage.

Door and Ballast

The door 62 of the present invention may exceed both the length and width of the opening 58 dimensions to securely overlap the cover 12 around the opening 58. In a food enclosure 10 this prevents undesired entry by insects or debris. The base of the door 62 may be provided with ballast along the width to assure that the overlap of the door 62 remains flush along the sides of the opening 58. The doors 62 are preferably made of the same or similar material as the cover 12. The ballast may be made of any elongated material that is the same or longer than the width of the door 62 and provides sufficient weight to keep the door 62 flush along the side of the opening 58. For example the ballast may be prepared from rod stock made of metal, heavy wood, heavy polymer or a tubular stock filled with sand or metal pellets and the like.

Preparation

The cover 12 material is cut from a desired material stock and preferably sewn together in a way that resists tearing from stretching and seam separation from continued use. The structural supports are preferably made of a continuous length of flexible polymer. The ballasts are preferably cut from solid cylindrical stock material of the desired diameter and of sufficient weight to exert the desired downward force on the doors 62. The doors 62 are prepared separately having a sleeve on one end to receive the ballast. The doors 62 are preferable sewn over the openings 58 in the cover 12 so that there is a substantial overlap on all sides of the opening 58 with the ballast sleeve positioned at the base of the opening 58.

Use

Figure 8A:
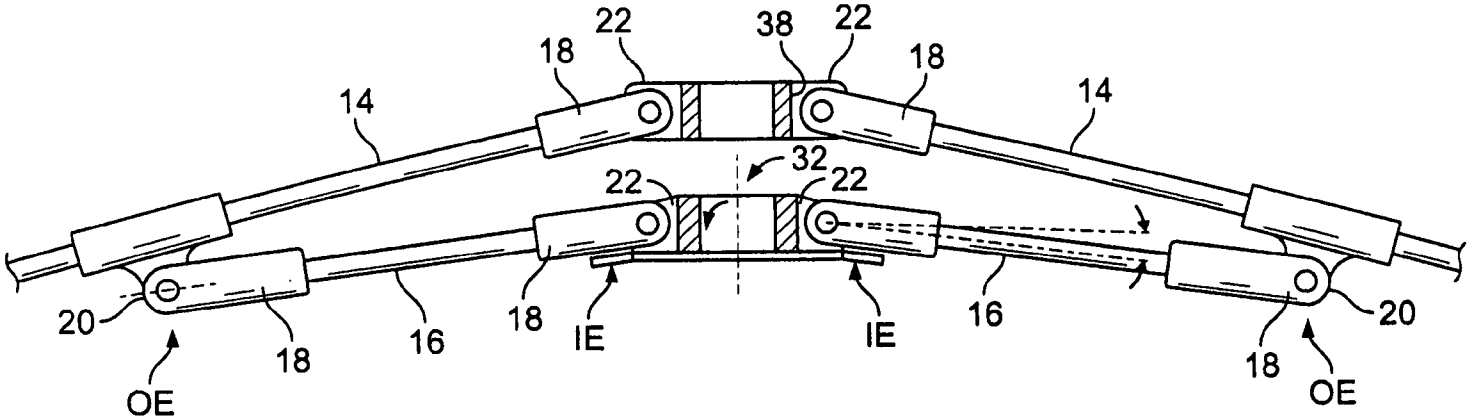
FIG. 8 (A) side view of the first hub and static pressure plate hub when the enclosure is in the open configuration with the downward bias of the struts against the pressure plates of the static pressure plate hub (B) side view of the first hub and static pressure plate hub just before the enclosure is locked in the open configuration without the downward bias.

When the device of the present invention is configured as a tent wherein the cover is affixed to the structural support beams, it may be converted from its collapsed structure to its constructed configuration by first unfolding the hinge joints of the structural support beams to cover the fully collapsed structure into a partially collapsed structure. The open ends of the structural support beams are inserted into the adapters provided on the cover. When the second hub reaches its uppermost position in close proximity to the first hub but not contacting the first hub the inner ends of the struts may be slightly elevated above the outer ends of the struts with the inner ends of the struts engaging the pressure plate (FIG. 8A). The pressure plate exerts an upward bias against the struts holding the structural support beams in the fully opened configuration. The structural support beams bow to an arcuate configuration based on their interaction with or connection to the cover thereby providing a fully constructed configuration.

Figure 8B:
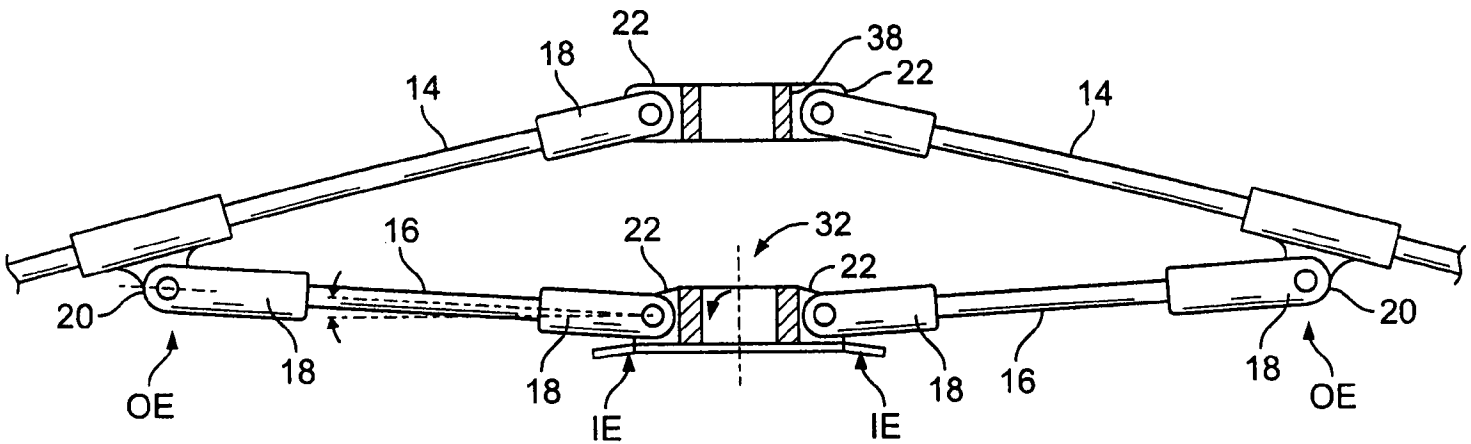

When is it desired to return the enclosure to its fully collapsed configuration, the user may simply release the upward bias against the struts by pulling the second hub downward to a position where the inner ends of the struts are lower than the outer ends. The loss of the upward bias on the pressure plates allows the structure to assume the partially collapsed configuration (FIG. 8B). Thereafter the hinge joints may be folded over to place the structure in its fully collapsed configuration. In this configuration the enclosure may be place in an optional carrying case or otherwise carried or transported with ease.

When the enclosure is used for food it is constructed in a similar manner as that described above. Tie down straps affixed to the base of the cover are used to encircle the surface on which the enclosure has been placed and secure it to the surface or table top. When entering the enclosure the door is lifted or rolled and secured in the open position above the opening. Food on plates, in bowls or other containers may be inserted into the enclosure through the opening. When the food is in position the door is released and allowed to lay flush and cover the opening preventing unwanted insects or debris from entering the food.

What is claimed is:

1. A collapsible enclosure comprising:

a plurality of structural support beams;

a first hub to which one end of said structural support beams are attached;

a second hub positioned beneath said first hub having an attachment member and a rotating member;

a plurality of strut members having inner and outer ends said outer ends being pivotally attached to a structural support beam and said inner ends being pivotally attached to said attachment member of said second hub said rotating member able to be rotated for engaging and forcing said plurality of strut members outward from said second hub and against said structural support beams;

a cover disposed upon and traversing between said structural support beams having a top portion and a bottom portion, said top portion having means for receiving said plurality of structural support beams, said bottom portion having adapters for receiving the other ends of said plurality of structural support beams, said cover having one or more openings and one or more flaps to secure said one or more openings.

2. The collapsible enclosure according to claim 1 wherein the rotating member of the hub is angled downward from the plane of said hub not less than 5 degrees.

3. The collapsible enclosure according to claim 1 wherein the rotating member of the hub is angled downward from the plane of said hub not more than 60 degrees.

4. The collapsible enclosure according to claim 1 wherein said rotating member further comprises a handle positioned below said rotating member for gripping and rotating said rotating member into position engaging and forcing said plurality of structural supports beams outward from said second hub.

5. The collapsible enclosure according to claim 1 further comprising a rotation stop on said rotating member to prevent over rotation of said rotating member.

6. The collapsible enclosure according to claim 1 may further comprise hinged joints on said structural supports beams between their ends so that they may be folded when in the enclosure is in the collapsed configuration.

7. The collapsible enclosure according to claim 1 wherein said inner ends of said strut members when said enclosure is in the constructed configuration exerts a downward bias against said rotating member of said second hub maintaining the structure in its constructed configuration.

8. The collapsible enclosure according to claim 1 wherein the downward pressure on said first hub causes the inner ends of said strut members to move below the outer ends of said strut members thereby overcoming the downward bias on said second hub and allowing said enclosure to collapse.

9. The collapsible enclosure according to claim 1 wherein said adapters for receiving the other ends of said structural support beams are flexible pockets.

10. The collapsible enclosure according to claim 1 wherein said second hub comprising said rotating member further comprises a locking structure for mechanically locking said strut members in position maintaining the downward bias toward the pressure plates by the strut members.

11. A collapsible enclosure comprising:

a plurality of structural support beams;

a hub having a plurality of attachment means and a pressure plate positioned below said attachment means to which one end of the structural support beams are attached; wherein the pressure plate of the hub is angled downward from the plane of said hub not less than 5 degrees; and a cover disposed upon and traversing between said structural support beams having a top portion and a bottom portion, the top portion having means for receiving said plurality of structural support beams, the bottom portion having adapters for receiving the other ends of said plurality of structural support beams, said cover having one or more openings and one or more flaps to secure said one or more openings.

12. A collapsible enclosure comprising:

a plurality of structural support beams;

a hub having a plurality of attachment means and a pressure plate positioned below said attachment means to which one end of the structural support beams are attached; wherein the pressure plate of the hub is angled downward from the plane of said hub not more than 85 degrees; and a cover disposed upon and traversing between said structural support beams having a top portion and a bottom portion, the top portion having means for receiving said plurality of structural support beams, the bottom portion having adapters for receiving the other ends of said plurality of structural support beams, said cover having one or more openings and one or more flaps to secure said one or more openings.

13. A collapsible enclosure is provided comprising:

a plurality of structural support beams;

a first hub having a plurality of first attachment means to which one end of said structural support beams are attached;

a second hub having a plurality of second attachment means and pressure plate positioned below said second attachment means;

wherein the pressure plate of the hub is angled downward from the plane of said hub not less than 5 degrees;

a plurality of strut members having inner and outer ends the outer ends being pivotally attached to a structural support beam and the inner ends being pivotally attached to a second attachment means of said second hub such that when engaging said pressure plates said struts are forced outward from said second hub and against said structural support beams; and a cover disposed upon and traversing between the structural support beams having a top portion and a bottom portion, the top portion having means for receiving the plurality of structural support beams, the bottom portion having adapters for receiving the ends of the plurality of structural support beams, said covering having one or more openings and one or more flaps to secure said one or more openings.

14. A collapsible enclosure is provided comprising:

a plurality of structural support beams;

a first hub having a plurality of first attachment means to which one end of said structural support beams are attached;

a second hub having a plurality of second attachment means and pressure plate positioned below said second attachment means;

wherein the pressure plate of the hub is angled downward from the plane of said hub not more than 60 degrees;

a plurality of strut members having inner and outer ends the outer ends being pivotally attached to a structural support beam and the inner ends being pivotally attached to a second attachment means of said second hub such that when engaging said pressure plates said struts are forced outward from said second hub and against said structural support beams; and a cover disposed upon and traversing between the structural support beams having a top portion and a bottom portion, the top portion having means for receiving the plurality of structural support beams, the bottom portion having adapters for receiving the ends of the plurality of structural support beams, said covering having one or more openings and one or more flaps to secure said one or more openings.

15. A collapsible enclosure comprising:

a plurality of structural support beams;

a hub having an attachment member to which one end of said structural support beams are attached and a rotating member for engaging and forcing said plurality of structural supports beams outward from said hub;

wherein the rotating member of the hub is angled downward from the plane of said hub not less than 5 degrees; and a cover disposed upon and traversing between said structural support beams having a top portion and a bottom portion, said top portion having means for receiving said plurality of structural support beams, said bottom portion having adapters for receiving said ends of said plurality of structural support beams, said cover having one or more openings and one or more flaps to secure said one or more openings.

16. A collapsible enclosure comprising:

a plurality of structural support beams;

a hub having an attachment member to which one end of said structural support beams are attached and a rotating member for engaging and forcing said plurality of structural supports beams outward from said hub;

wherein the rotating member of the hub is angled downward from the plane of said hub not more than 85 degrees; and a cover disposed upon and traversing between said structural support beams having a top portion and a bottom portion, said top portion having means for receiving said plurality of structural support beams, said bottom portion having adapters for receiving said ends of said plurality of structural support beams, said cover having one or more openings and one or more flaps to secure said one or more openings.

17. A collapsible enclosure comprising:

a plurality of structure support beams;

a hub having an attachment member to which one end of said structural support beams are attached and a rotating member for engaging and forcing said plurality of structural supports beams outward from said hub wherein said rotating member comprises a handle for gripping and rotating said rotating member into position engaging and forcing said plurality of structural supports beams outward from said hub; and a cover disposed upon and traversing between said structural support beams having a top portion and a bottom portion, said top portion having means for receiving said plurality of structural support beams, said bottom portion having adapters for receiving said ends of said plurality of structural support beams, said cover having one or more openings and one or more flaps to secure said one or more openings.

18. A collapsible enclosure is provided comprising:

a plurality of structural support beams;

wherein said structural support beams further comprise hinged joints between their ends so that they may be folded when the enclosure is in the collapsed configuration;

a first hub having a plurality of first attachment means to which one end of said structural support beams are attached;

a second hub having a plurality of second attachment means and pressure plate positioned below said second attachment means;

a plurality of strut members having inner and outer ends the outer ends being pivotally attached to a structural support beam and the inner ends being pivotally attached to a second attachment means of said second hub such that when engaging said pressure plates said struts are forced outward from said second hub and against said structural support beams;

a cover disposed upon and traversing between the structural support beams havin a top portion and a bottom portion, the top portion having means for receiving the plurality of structural support beams, the bottom portion having adapters for receiving the ends of the plurality of structural support beams, said covering having one or more openings and one or more flaps to secure said one or more openings.

* * * * *